US009010387B2

(12) United States Patent
Meinzinger et al.

(10) Patent No.: US 9,010,387 B2
(45) Date of Patent: Apr. 21, 2015

(54) DEVICE AND METHOD FOR FILLING CONTAINERS

(75) Inventors: Rupert Meinzinger, Kirchroth (DE); Stefan Poeschl, Regensburg (DE); Sebastian Baumgartner, Prackenbach (DE)

(73) Assignee: Krones AG (DE)

( * ) Notice: Subject to any disclaimer, the term of this patent is extended or adjusted under 35 U.S.C. 154(b) by 614 days.

(21) Appl. No.: 13/309,849

(22) Filed: Dec. 2, 2011

(65) Prior Publication Data

US 2012/0152402 A1 Jun. 21, 2012

(30) Foreign Application Priority Data

Dec. 3, 2010 (DE) ..... 10 2010 053 201

(51) Int. Cl.
*B65B 43/42* (2006.01)
*B67C 3/00* (2006.01)
*B67C 3/28* (2006.01)

(52) U.S. Cl.
CPC ..... *B67C 3/287* (2013.01)

(58) Field of Classification Search
CPC ..... B67C 3/287
USPC ..... 141/2, 95, 144–147
See application file for complete search history.

(56) References Cited

U.S. PATENT DOCUMENTS

| | | | | |
|---|---|---|---|---|
| 5,148,841 | A | 9/1992 | Graffin | 141/83 |
| 5,713,403 | A * | 2/1998 | Clusserath et al. | 141/101 |
| 6,148,876 | A * | 11/2000 | Corniani et al. | 141/84 |
| 6,237,650 | B1 * | 5/2001 | Ansaloni | 141/237 |
| 6,644,363 | B2 * | 11/2003 | Sogliani et al. | 141/83 |
| 7,856,891 | B2 | 12/2010 | Kirst et al. | 73/861.355 |
| 7,866,123 | B2 * | 1/2011 | Clusserath | 53/202 |
| 8,573,268 | B2 * | 11/2013 | Burgmeier et al. | 141/145 |
| 8,662,114 | B2 * | 3/2014 | Meinzinger | 141/9 |
| 8,701,719 | B2 * | 4/2014 | Clusserath | 141/9 |
| 8,757,225 | B2 * | 6/2014 | Knieling | 141/104 |
| 2002/0000259 | A1 | 1/2002 | Suzuki et al. | 141/94 |
| 2009/0249890 | A1 | 10/2009 | Kirst et al. | 73/861.354 |
| 2011/0017345 | A1 | 1/2011 | Monzel | 141/1 |

FOREIGN PATENT DOCUMENTS

| | | | |
|---|---|---|---|
| DE | 19741254 | 11/1998 | B67C 3/32 |
| DE | 19925039 | 12/2000 | B65B 3/28 |
| DE | 19951555 | 5/2001 | B65B 3/28 |

(Continued)

OTHER PUBLICATIONS

European Search Report, dated Mar. 14, 2012 (8 pgs).

(Continued)

*Primary Examiner* — Timothy L Maust
(74) *Attorney, Agent, or Firm* — Hayes Soloway P.C.

(57) ABSTRACT

Method for filling containers with liquids, wherein the containers are filled using a plurality of controllable filling elements and the liquid is fed to these filling elements starting from a reservoir, common to the filling elements, for storing the liquid, wherein during the filling the containers are transported at least in sections along a circular track and wherein the filling of the containers by at least one filling element is controlled as a function of at least one first parameter characteristic of the liquid in the reservoir and this parameter is determined repeatedly at given intervals of time during the filling operation.

9 Claims, 2 Drawing Sheets

(56) References Cited

FOREIGN PATENT DOCUMENTS

| | | | |
|---|---|---|---|
| DE | 10149473 | 4/2003 | B65B 3/00 |
| DE | 102008016235 | 10/2009 | B67C 3/00 |
| DE | 102008016846 | 10/2009 | B67C 3/30 |
| DE | 102008018089 | 10/2009 | B65B 3/26 |
| EP | 0406092 | 1/1991 | B65B 3/28 |
| EP | 1447329 | 8/2004 | B65B 3/34 |
| GB | 2288168 | 10/1995 | B67C 3/20 |
| WO | WO9700224 | 1/1997 | B67C 3/20 |
| WO | WO2005080202 | 9/2005 | B65B 3/36 |

OTHER PUBLICATIONS

German Search Report, dated Jun. 9, 2011 (5 pgs).

* cited by examiner

DEVICE AND METHOD FOR FILLING CONTAINERS

BACKGROUND OF THE INVENTION

The present invention relates to a device and a method for filling containers with liquids. Such devices and methods have been known from the prior art for a long time. Thus, for example, filling devices are known which have a plurality of filling elements which are arranged, for example, on a filling wheel and which each fill the containers arranged on them with liquid. In this context, methods for controlling the particular filling elements are also known from the prior art. Thus, for example, it is known that the individual filling elements perform time-controlled dosing of the liquid products. A weight-dependent, for example, control as a function of a filling weight already reached would also be possible.

In filling processes it is not possible to keep the influencing variables of the filling operation constant. During the filling operation variations in the tank level, temperature variations in the products, drops in the working pressure and different filler speeds of rotation arise.

WO 97/00224 discloses a method for filling containers with a liquid which is under pressure. In this method, the pressure of a liquid is measured and passed on to a control device which, from the liquid pressure measured and the notional filling amount to be filled, controls the filling valve by means of a control signal. The control device furthermore calculates the filling amount actually filled from a totalling of part volumes which are obtained taking into account the particular liquid pressure measured, the intervals of time between the individual pressure measurements and a pressure/flow characteristic curve of the filling valve.

WO 2005/080202 A1 describes a filling machine with time-controlled dosing valves. In this, at least one master valve is provided, which has a flow meter device which is connected to a computer unit which calculates the time for the filling. The further filling valves of the unit are controlled on the basis of this flow meter device and the output data from this.

In this procedure it has proved problematic that the individual filling valves often deviate from one another and the control methods known from the prior art therefore do not take into account such a deviation of the valves with respect to one another.

The present invention is therefore based on the object of providing a method for time-controlled dosing of liquid products which also takes into account variabilities in the individual filling elements or valves.

SUMMARY OF THE INVENTION

In a method according to the invention for filling containers with liquids, the containers are filled by means of a plurality of controllable filling elements and the liquid is fed to these filling elements starting from a reservoir, common to the filling elements, for storing the liquid. In this context, during the filling the containers are transported at least in sections along a circular track and the filling of the containers by at least one filling element is controlled as a function of at least one first parameter characteristic of the liquid in the reservoir. In this context, this parameter is determined repeatedly at given intervals of time during the filling operation.

According to the invention, the filling of the containers by at least a second filling element is likewise controlled as a function of the parameter characteristic of the liquid in the reservoir, wherein for the control of at least one filling element at least one parameter characteristic of this filling element is additionally taken into account. Overall, a time-related filling method is therefore preferably carried out.

It is therefore initially proposed that during transfer of the liquid products an incremental polling of the influencing variables of the filling operation is carried out. However, since the individual filling elements are not completely identical to one another and also do not display completely identical filling properties, it is proposed according to the invention that this variability of the individual filling elements is also taken into account. In this manner it is possible, but not absolutely necessary, for a master valve to be used for the control, but for the remaining valves and their differences likewise to be taken into account.

Advantageously, the reservoir for the liquid also rotates with the individual filling elements.

In a further advantageous method, the filling element has and preferably all the filling elements have in each case controllable filling valves which control the filling operation of the liquid into the containers.

In order to be able to react constantly to the influencing variables of the filling operation, for example variables which depend on the liquid in the reservoir, a control which calculates the course of the filling operation incrementally and in this way controls the filling time is advantageously used.

Advantageously, for control of a plurality of filling elements at least one parameter in each case characteristic of these filling elements is taken into account. Advantageously, for control of all the filling elements at least one parameter is in each case characteristic of these filling elements is taken into account. In this context, this particular characteristic parameter can be determined, for example, in the context of a calibrating operation for each individual filling element.

In a further advantageous method, the tilling of the containers is controlled as a function of a plurality of parameters characteristic of the liquid in the reservoir. In this context it is possible for the said parameters to be recorded regularly.

In a further advantageous method, the parameter is chosen from a group of parameters which contains a temperature of the liquid in the reservoir, a geodetic height of the liquid in the reservoir, a circular frequency of a rotation of the reservoir, a level of the liquid in the reservoir, a density of the liquid in the reservoir, a pneumatic working pressure, combinations of these and the like.

Advantageously, in each time increment the pneumatic working pressure, the filler speed of rotation, the product temperature and the current level in the tank are polled and the filling amount of this time interval is calculated from these. The individual filling amounts of the time increments are added up in the course of the filling and compared with the cut-off filling amount. Advantageously, when the cut-off filling amount is reached, a cut-off signal is issued and the filling valve in question is thus closed.

In a further advantageous method, the parameter characteristic of the filling element is determined as a function of a flow-through amount of the liquid passing through this filling element. In particular, in this context the said filling element is kept in an opened position and the flow passing through this opened valve is determined.

In a further advantageous method a height of the level of the liquid in the reservoir is determined as a function of a distance from a geometric axis of rotation of the reservoir. It is to be taken into account here that the level, in particular in the event of relatively fast revolutions, is not constant as a function of this distance, but, for example, funnel-like formations may result, which have the effect that closer to axis of rotation the level is lower and further outwards the level is higher.

In a further advantageous method, at least one characteristic parameter is determined in a calibration operation of the unit and is stored in a memory device. In this case, for example, the particular filling amounts or also the flow amounts through the individual opened filling valves can be measured and actual deviations of the filling elements with respect to one another or also with respect to a reference value can be determined with the aid of these filling amounts and/or flow amounts.

Advantageously, the parameter characteristic of the filling element is determined by filling containers with at least two different filling amounts. The individual filling elements deviate from one another in particular during the opening operation of the valves and during the closing operation of the valves, but also during the filling operation with a constant flow rate. By calibration with two different filling amounts, those differences which arise in particular during the opening and the closing of the particular valve can be determined very accurately in this manner.

The present invention is furthermore reported to a device for filling containers with liquids. This device here has a carrier which can be rotated about a given axis of rotation and on which a plurality of controllable filling elements for filling the containers are arranged. The device furthermore has a reservoir for storing the liquid to be transferred and for supplying the filling elements with the liquid. In this context, this reservoir can also be rotated about the given axis of rotation and is equipped with at least one first sensor device which records at least one first parameter characteristic of the liquid in the reservoir.

A control device which controls the tilling of the containers by the individual filling elements on the basis of the first parameter is furthermore provided.

According to the invention, the filling courses by the individual filling elements can be controlled independently of one another, and for the control of at least one filling element the control device additionally takes into account at least one parameter characteristic of this second filling element or a filling operation by means of this filling element.

It is therefore also proposed with respect to the device that the variability of the individual filling elements or the specific characteristics of the individual filling elements are taken into account during the control thereof.

In a preferred embodiment, the device has a memory device in which parameters characteristic of each individual filling element are stored.

Further advantages and embodiments can be seen from the attached drawings:

BRIEF DESCRIPTION OF THE DRAWINGS

These show.

DETAILED DESCRIPTION OF THE INVENTION

Figure 1:
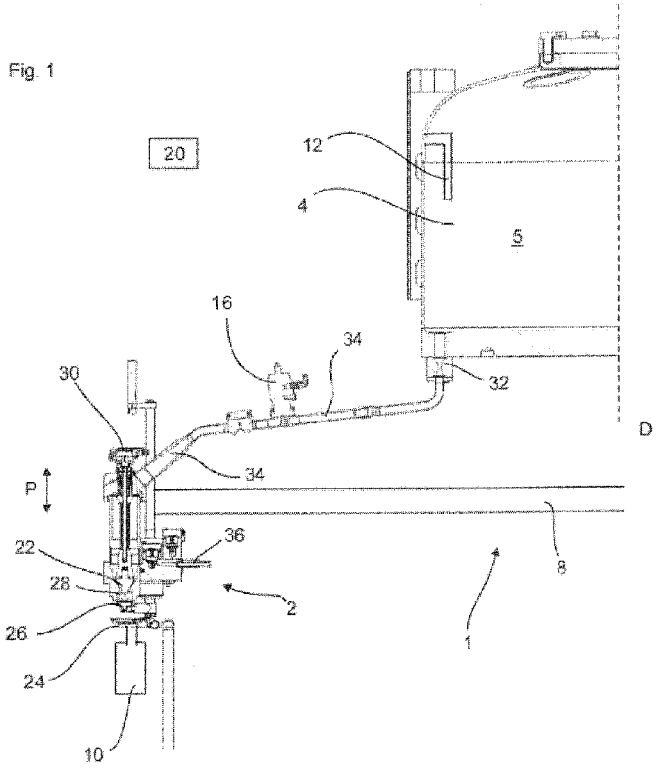
FIG. 1 a schematic diagram of a device for filling containers.

FIG. 1 shows a schematic diagram of a device 1 for filling containers. This device here has a reservoir 4 in which a liquid 5 is arranged. This reservoir rotates here about an axis of rotation D. Reference symbol 8 identifies in rough outline a carrier—such as, for example, a filling wheel—on which a plurality of filling elements 2 is arranged, each of which serves to fill the containers 10. For this purpose, the filling elements 2 have filling valves, these filling valves here having filling cones 22 which can be moved along the double arrow P. Reference symbol 24 identifies a carrier for the container and reference symbol 26 identifies a so-called CIP cap which can be mounted on the delivery opening 28 of the filling element 2 for cleaning the filling element. Reference symbol 36 refers to a return line for returning a cleaning medium. The carrier is likewise arranged such that it can be rotated about the axis of rotation D, rotating synchronously with the reservoir 4 with the same circular frequency.

Reference symbol 30 identifies in its entirety a drive for the filling element 2, i.e. the drive which controls the filling of the containers 10. Reference symbol 34 identifies the product line which leads from the reservoir 4 to the individual filling elements 2. Filling speeds can be controlled by means of a membrane valve 16, more precisely the changeover to a second filling speed can be effected here. Reference symbol 32 identifies a choke arranged on the outflow of the reservoir 4.

Reference symbol 12 identifies in rough outline a sensor device which measures at least one characteristic property of the liquid 5 in the reservoir 4. As mentioned above, this can be, for example, a temperature or also a level of this liquid. However, several sensor devices can also be provided.

A control device 20 controls the filling of the containers 10 with the filling material as a function of the parameters measured.

Figure 2:
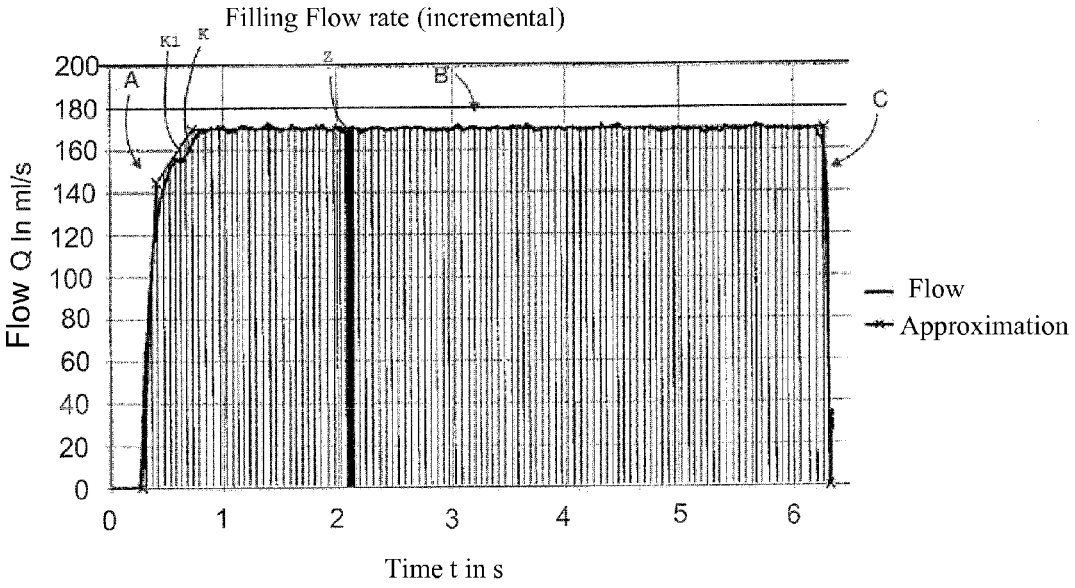
FIG. 2 a diagram of a filling course for a filling element.

FIG. 2 shows a flow curve K which illustrates the filling of the containers with a particular filling valve. In this figure, the time in seconds is plotted on the ordinate and the flow Q in ml/s is plotted on the coordinate. It can be seen that in a starting section A the flow Q initially increases sharply, it then remains essentially constant over a certain period of time (section B) and finally returns to zero again in a section C. In this context, the black line K identifies the actual flow and the line K1 identifies an approximation of the flow.

It can be seen that the filling operation is divided into a plurality of time increments Z, during which the individual measurement parameters are measured.

An important component in the calculation of this flow curve K1 is the maximum flow rate $Q_{max}$. This is recalculated in each time increment Z and depends, for example, on the geodetic height z of the product to be transferred (this geodetic height resulting from the base height of the reservoir plus the level in the tank). A further parameter for determining the flow rate is the centrifugal acceleration a, (at a circular frequency ω) and the product temperature T. Taking into account these parameters, the flow rate $Q_{max}$ is calculated according to the following formula:

$$Q_{max} = \left(\left(-1 - 10^{-3} \cdot \left(\frac{\omega^2}{2 \cdot g} \cdot (r_i^2 - r_s^2) + z_s\right) - 8,4 \cdot 10^{-3}\right) \cdot T^2 + \left(-4 \cdot 10^{-4} \cdot \left(\frac{\omega^2}{2 \cdot g} \cdot (r_i^2 - r_s^2) + z_s\right) + 1,3525\right) \cdot T + \left(15,68 \cdot 10^{-2} \cdot \left(\frac{\omega^2}{2 \cdot g} \cdot (r_i^2 - r_s^2) + z_s\right) + 70,01\right)\right) + \overline{a}_z \cdot \left(-5,6543 \cdot 10^{-3} \cdot \left(\frac{\omega^2}{2 \cdot g} \cdot (r_i^2 - r_s^2) + z_s\right) + 10,979\right)$$

Needless to say, the individual filling elements are mechanical components which bring with them different dead times and flow resistances because of their production tolerances. According to the invention, a correction method for the other filling valves is therefore proposed.

Figure 3:
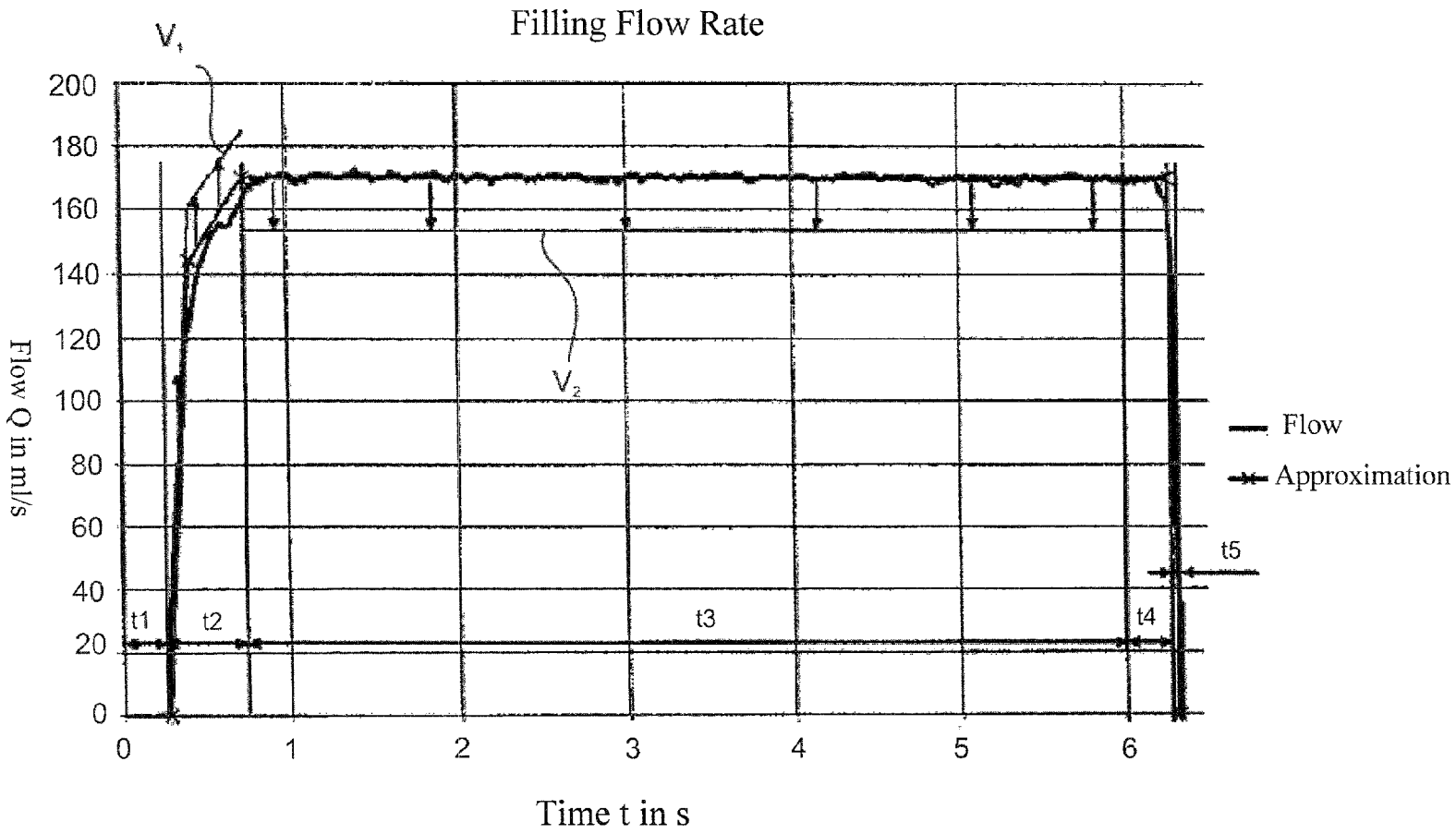
FIG. 3 a further diagram of the division of the filling course.

FIG. 3 shows a diagram which illustrates this method. In this, the flow operation is divided into five time sections t1, t2, t3, t4 and t5. Time t1 is the dead time of the valve, which depends on the working pressure of the pneumatic controlling of the valve. The period of time t2 identifies the increasing region of the flow curve, this period of time depending on the level in the reservoir, the speed of rotation thereof and the product temperature. The period of time t3 identifies the constant filling region up to the cut-off point in time, which can be calculated as a function of the filling amount to be introduced.

The periods of time t4 and t5 designate the after-running time from the cut-off point in time, this after-running time in turn depending on the level, the speed of rotation and the product temperature.

The calibration of the individual filling elements is described in detail in the following. If two different filling amounts are transferred, exclusively the length of the time span t3 changes. A filling with a first filling amount of, for example, 500 ml and a filling with a second filling amount of, for example, 1,000 ml are taken as the basis. The ratio of the calculated time spans t3 for the filling amounts here is for example, as has been confirmed by experiment, 1:2.24. The notional volume is set on the device 1 initially at 500 ml and then at 1,000 ml and a filling operation is then performed in each case. The actual filling amounts are weighed in order to deter mine the volume actually transferred. The deviation of the actual from the notional volume is designated $\Delta V_{500}$ for the 500 ml filling and $\Delta V_{1000}$ for the 1,000 ml filling. These values $\Delta V_{500}$ and $\Delta V_{1000}$ are then each divided into a deviation in the constant filling region X1 and into a deviation in the increasing region X2. The ratio of the running times of the constant filling region of a 1,000 ml and a 500 ml filling is 2.24. In this manner, the following relationships result for the two filling amounts:

For the filling amount deviation of the 500 ml filling:

$$\Delta V_{500}=X_1+X_2$$

For the filling amount deviation of the 1,000 ml filling:

$$\Delta V_{1000}=2.24\cdot X_1+X_2.$$

In this manner, the following relationships result for the deviations $$X_2=\frac{2.24\cdot\Delta V_{500}-V_{1000}}{1.24}$$

$$X_1=\Delta V_{500}-\frac{2.24\cdot\Delta V_{500}-V_{1000}}{1.24}$$

In this manner, the precise deviations of the filling amount in the particular regions can be determined. For determining the flow corrections ΔQ1 and ΔQ2, the tilling amount in the increasing region is divided by the increasing time and the filling amount in the constant filling region is divided by the time span of this filling region:

$$\Delta Q_1=\frac{X_2}{t_2}$$

-continued $$\Delta Q_2=\frac{X_1}{t_3}$$

The parallel shift of the flow course by ΔQ1 and ΔQ2 in the region of t2 and t3 is represented in FIG. 3 by the lines $V_1$ and $V_2$.

In this manner, overall it is possible to determine, on the basis of the actual filling amounts filled by the individual filling elements, correction factors or flow corrections ΔQ1 and ΔQ2 which are characteristic of the individual filling elements. In this context, these corrections ΔQ1 and ΔQ2 can be stored for each individual valve in a memory device and can be taken into account for each of the filling elements in question in the actual working operation.

In this context, it is advisable to carry out this calibration envisaged here again at certain intervals of time, for example once a month, in order to determine the particular flow corrections ΔQ1 and ΔQ2 for the individual filling elements.

The applicant reserves the right to claim as essential to the invention all the features disclosed in the application text where, individually or in combination, they are novel with respect to the prior art.

LIST OF REFERENCE SYMBOLS

1 Device
2 Filling elements
4 Reservoir
5 Liquid
8 Carrier
10 Containers
12 Sensor device
16 Membrane valve
20 Control device
22 Filling cone
24 Carrier
26 CIP cap
30 Drive
32 Choke
34 Product line
36 Return line
A Starting section
$a_z$ Centrifugal acceleration
B Section
C Section
D Axis of rotation
K Flow curve, actual flow
K1 Approximation of the flow
P Double arrow
Q Flow
$Q_{max}$ Flow rate
T Product temperature
Z Time increment
t1 Dead time of the valve
t2 Increasing region of the flow curve
t3 Constant filling region
t4, t5 After-running time from the cut-off point in time
X1 Constant filling region
X2 Increasing region
ΔQ1, ΔQ2 Flow corrections
ω Circular frequency

The invention claimed is:

1. A device for filling containers with a liquid, comprising a carrier which can be rotated about a given axis of rotation (D) and on which a plurality of controllable filling elements for filling the containers are arranged, a reservoir for storing the liquid and for supplying the filling elements with the liquid, wherein the reservoir can be rotated about the given axis of rotation (D), and with at least one first sensor device which records at least one first parameter characteristic of the liquid in the reservoir, and with at least one control device which controls the filling of the containers by the individual filling elements on the basis of the first parameter, wherein filling by the individual filling elements can be controlled independently of one another and for the control of at least one filling element the control device additionally takes into account at least one parameter (ΔQ1, ΔQ2) characteristic of a second filling element.

2. The device according to claim 1, wherein the device has a memory device in which parameters (ΔQ1, ΔQ2) characteristic of each individual filling element are stored.

3. A method for filling containers with liquids, comprising providing a filling device as claimed in claim 1 including a plurality of individually controllable first and second filling elements, filling the containers using the plurality of controllable filling elements by feeding the liquid to the filling elements from a reservoir, common to the filling elements, wherein during the filling the containers are transported at least in sections along a circular track, and controlling the filling of the containers by at least one filling element as a function of a plurality of parameters characteristic of the liquid in the reservoir, which parameter is determined repeatedly at given intervals of time during the filling operation wherein filling of the containers by at least the second filling element is likewise controlled as a function of a plurality of parameters characteristic of the liquid in the reservoir, wherein for the control of at least one filling element at least one parameter (ΔQ1, ΔQ2) characteristic of this filling element is additionally taken into account.

4. The method according to claim 1, wherein for the control of a plurality of filling elements, at least one parameter (ΔQ1, ΔQ2) in each case characteristic of the filling elements is taken into account.

5. The method according to claim 1, wherein the parameters are selected from the group consisting of a temperature of the liquid in the reservoir, a geodetic height of the liquid in the reservoir, a circular frequency of a rotation of the reservoir, a density of the liquid in the reservoir, a pneumatic working pressure, and a combination thereof.

6. The method according to claim 1, wherein the parameter (ΔQ1, ΔQ2) characteristic of the filling element is determined as a function of a flow-through amount of the liquid passing through this filling element.

7. The method according to claim 1, wherein a height of the level of the liquid in the reservoir is determined as a function of a distance from a geometric axis of rotation (D) of the reservoir.

8. The method according to claim 1, wherein at least one characteristic parameter (ΔQ1, ΔQ2) is determined in a calibration operation of the unit and is stored in a memory device.

9. The method according to claim 6, wherein the parameter (ΔQ1, ΔQ2) characteristic of the filling element is determined by filling containers with at least two different filling amounts.

* * * * *

UNITED STATES PATENT AND TRADEMARK OFFICE

CERTIFICATE OF CORRECTION

PATENT NO. : 9,010,387 B2
APPLICATION NO. : 13/309849
DATED : April 21, 2015
INVENTOR(S) : Meinzinger et al.

It is certified that error appears in the above-identified patent and that said Letters Patent is hereby corrected as shown below:

In the claims

Claim 4, Col. 8, line 3, “claim 1” should be --claim 3--.

Claim 5, Col. 8, line 8, “claim 1” should be --claim 3--.

Claim 6, Col. 8, line 16, “claim 1” should be --claim 3--.

Claim 7, Col. 8, line 21, “claim 1” should be --claim 3--.

Claim 8, Col. 8, line 26, “claim 1” should be --claim 3--.

Signed and Sealed this
Fifteenth Day of December, 2015

Michelle K. Lee

Michelle K. Lee
*Director of the United States Patent and Trademark Office*